US009670614B2

(12) United States Patent
Zhou et al.

(10) Patent No.: US 9,670,614 B2
(45) Date of Patent: Jun. 6, 2017

(54) COLOR MODIFICATION OF TEXTILE

(75) Inventors: Yucheng Zhou, Beijing (CN); Chu Wang, Beijing (CN); Lisbeth Kalum, Vaerloese (DK); Lars Henrik Oestergaard, Charlottenlund (DK); Wenqi Huang, Beijing (CN)

(73) Assignee: Novozymes A/S, Bagsvaerd (DK)

( * ) Notice: Subject to any disclaimer, the term of this patent is extended or adjusted under 35 U.S.C. 154(b) by 0 days.

(21) Appl. No.: 14/343,925

(22) PCT Filed: Sep. 7, 2012

(86) PCT No.: PCT/CN2012/081153
§ 371 (c)(1),
(2), (4) Date: Jul. 10, 2014

(87) PCT Pub. No.: WO2013/040991
PCT Pub. Date: Mar. 28, 2013

(65) Prior Publication Data

US 2014/0310887 A1 Oct. 23, 2014

Related U.S. Application Data

(60) Provisional application No. 61/549,795, filed on Oct. 21, 2011.

(30) Foreign Application Priority Data

Sep. 23, 2011 (WO) ..... PCT/CN2011/080113

(51) Int. Cl.

| | |
|---|---|
| ***D06L 3/11*** | (2006.01) |
| ***D06P 1/32*** | (2006.01) |
| ***D06M 16/00*** | (2006.01) |
| ***D06P 5/13*** | (2006.01) |
| ***D06P 5/15*** | (2006.01) |
| ***D06L 1/12*** | (2006.01) |
| ***D06L 1/14*** | (2006.01) |
| ***D06L 1/22*** | (2006.01) |
| ***D06L 4/40*** | (2017.01) |
| ***D06L 4/10*** | (2017.01) |

(52) U.S. Cl.
CPC ..... *D06P 1/32* (2013.01); *D06L 1/12* (2013.01); *D06L 1/14* (2013.01); *D06L 1/22* (2013.01); *D06L 4/10* (2017.01); *D06L 4/40* (2017.01); *D06M 16/003* (2013.01); *D06P 5/132* (2013.01); *D06P 5/137* (2013.01); *D06P 5/153* (2013.01); *D06P 5/158* (2013.01)

(58) Field of Classification Search
CPC ..... D06P 1/32; D06P 5/132; D06M 16/003; D06L 3/11
USPC ..... 8/400, 115.51, 137.5, 138, 139, 401
See application file for complete search history.

(56) References Cited

U.S. PATENT DOCUMENTS

| | | | | |
|---|---|---|---|---|
| 5,817,495 | A | 10/1998 | Pedersen et al. | |
| 6,129,769 | A * | 10/2000 | Xu et al. | 8/401 |
| 8,802,423 | B2 * | 8/2014 | Lai et al. | 435/263 |
| 2008/0189871 | A1 | 8/2008 | McAuliffe et al. | |

FOREIGN PATENT DOCUMENTS

| | | | |
|---|---|---|---|
| DE | 19821263 | A1 | 11/1998 |
| DE | 19723912 | A1 | 12/1998 |
| WO | 94/12620 | A1 | 6/1994 |
| WO | 96/12845 | A1 | 5/1996 |
| WO | 99/34054 | A1 | 7/1999 |
| WO | 01/48304 | A1 | 7/2001 |
| WO | 2011/025861 | A1 | 3/2011 |

OTHER PUBLICATIONS

STIC Search Report dated Aug. 15, 2014.*
Gijzen, The Plant Journal, vol. 12, No. 5, pp. 991-998 (1997).

* cited by examiner

*Primary Examiner* — Eisa Elhilo
(74) *Attorney, Agent, or Firm* — Elias Lambiris

(57) ABSTRACT

The use of a peroxidase, a source of hydrogen peroxide and a mediator for providing a modified color in the textile is described.

18 Claims, No Drawings

COLOR MODIFICATION OF TEXTILE

CROSS-REFERENCE TO RELATED APPLICATIONS

This application is a 35 U.S.C. 371 national application of PCT/CN2012/081153 filed Sep. 7, 2012, which claims priority or the benefit under 35 U.S.C. 119 of international application no. PCT/CN2011/080113 filed Sep. 23, 2011 and U.S. provisional application No. 61/549,795 filed Oct. 21, 2011, the contents of which are fully incorporated herein by reference.

REFERENCE TO A SEQUENCE LISTING

This application contains a Sequence Listing in computer readable form, which is incorporated herein by reference.

FIELD OF THE INVENTION

The present invention relates to a process for providing a modified color in the textile, especially in the dyed cellulosic fabric such as denim, with a peroxidase, a source of hydrogen peroxide, and a mediator.

BACKGROUND OF THE INVENTION

The use of enzymes to treat textiles is now well established. Amylases are used for desizing, and cellulases are used for abrading. Enzymes such as laccases or perhydrolase have also been applied in textile processing for color modification, in place of harsh chemical bleaching treatment.

WO 96/12845 discloses a process for providing a bleached look in the colour density of the surface of dyed fabric, comprising contacting, in an aqueous medium, a dyed fabric with a phenol oxidizing enzyme system, such as a laccase together with oxygen, and an enhancing agent (mediator).

WO99/34054 discloses a process for removal of excess dye from dyed fabric with a rinse liquor comprising at least one peroxidise, an oxidase agent and at least one mediator, such as liquor comprising a peroxidase, hydrogen peroxidise and a mediator like 1-hydroxy-benzotriazole.

WO 2011/025861 discloses compositions and methods for the enzymatic abrading and color modification of dyed textiles with perhydrolases.

SUMMARY OF THE INVENTION

The present invention relates to a composition and method to treat the textile.

In one aspect, a composition is provided, comprising a peroxidase, a source of hydrogen peroxide, and a mediator having the chemical structure:

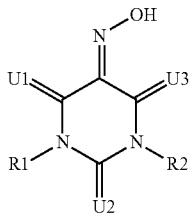

wherein U1, U2 and U3 are identical or different, and are O, S or NOH; and R1 and R2 are identical or different, and are hydrogen, hydroxyl, formyl, carbamoyl or sulfono radical, ester or salt of the sulfono radical, sulfamoyl, nitro, nitroso, amino, cyano, phenyl, benzyl $C_1$-$C_4$-alkyl, $C_1$-$C_4$-alkoxy, $C_1$-$C_4$-carbonyl, or carbonyl-$C_1$-$C_4$-alkyl.

In another aspect, the method of treating textile comprising contacting a textile with a peroxidase, a source of hydrogen peroxide, and a mediator, wherein a mediator having the chemical structure:

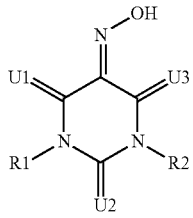

wherein U1, U2 and U3 are identical or different, and are O, S or NOH; and R1 and R2 are identical or different, and are hydrogen, hydroxyl, formyl, carbamoyl or sulfono radical, ester or salt of the sulfono radical, sulfamoyl, nitro, nitroso, amino, cyano, phenyl, benzyl $C_1$-$C_4$-alkyl, $C_1$-$C_4$-alkoxy, $C_1$-$C_4$-carbonyl, or carbonyl-$C_1$-$C_4$-alkyl.

In some embodiments, the method of the present invention causes a color modification in the textile. The color modification is selected from at least one of the following effects: lightening of color, change of color, change in color cast, reduction of redeposition/backstaining, and bleaching.

In some embodiments, the method for treating textile in an aqueous solution comprises (a) contacting the textile with cellulase to abrade the textile; (b) contacting a textile with a peroxidase, a source of hydrogen peroxide, and a mediator to modify the color of the textile. In some embodiments, between step (a) and (b), there is a wash step. In some embodiments, (a) and (b) are performed in a single bath without intervening wash steps. In some embodiments, (a) and (b) are performed sequentially or simultaneously in the same bath. In some embodiments, (a) and (b) are performed sequentially in a single bath, wherein (a) is performed prior to the (b).

In some embodiments, step (a) is preceded by an enzymatic desizing step. In some embodiments, the enzymatic desizing step may be performed in the same bath as (a). In some embodiments, the enzymatic desizing step is performed sequentially or simultaneously in the same bath as (a) and (b). In some embodiments, the enzymatic desizing step is performed sequentially in the same bath as (a) and (b), wherein the order of the steps is enzymatic desizing, step (a) and (b). In some embodiments, the enzymatic desizing step is performed in one bath, followed by a wash step, and step (a) and (b) performed in the same bath.

In some embodiments, the peroxidase enzyme may be a *Coprinus cinereus* peroxidase or a soybean peroxidase.

In some embodiments, the textile is dyed textile. In some embodiments, the dyed textile is dyed fabric. In some embodiments, the dyed textile is denim. In some embodiments, the dye is indigo dye. In some embodiments, the dye is sulfur dye.

In some embodiments, the method of treating textile is the method for manufacturing textile.

In some embodiments, the method or the composition of the present invention achieve color modification on the front side of the textile.

DETAILED DESCRIPTION OF THE INVENTION

As used herein, the singular forms "a", "an", and "the" include plural references unless the context clearly dictates otherwise. Thus, for example, references to "a peroxidase" include the use of one or more peroxidase. "A step" of a method means at least one step, and it could be one, two, three, four, five or even more method steps.

As used herein, the term "sequential" with reference to a plurality of enzymatic treatments of a textile, means that a second specified enzymatic treatment is performed after a first specified enzymatic treatment is performed. Sequential treatments may be separated by intervening wash steps. Where specified, sequential enzymatic treatments may be performed "in the same bath," meaning in the substantially the same liquid medium without intervening wash steps. Single-bath sequential treatment may include pH adjustments, temperature adjustment, and/or the addition of salts, activators, mediators, and the like, but should not include washes or rinses.

As used herein, the term "simultaneous," with reference to a plurality of enzymatic treatments of a textile, means that a second specified enzymatic treatment is performed at the same time (i.e., at least partially overlapping with) as a first specified enzymatic treatment. Simultaneous enzymatic treatments are necessarily performed "in the same bath" without intervening wash steps.

Peroxidase Enzymes

EC-numbers may be used for classification of enzymes. Reference is made to the Recommendations of the Nomenclature Committee of the International Union of Biochemistry and Molecular Biology, Academic Press Inc., 1992.

It is to be understood that the term enzyme, as well as the various enzymes and enzyme classes mentioned herein, encompass wild-type enzymes, as well as any variant thereof that retains the activity in question. Such variants may be produced by recombinant techniques. The wild-type enzymes may also be produced by recombinant techniques, or by isolation and purification from the natural source.

In a particular embodiment the enzyme in question is well-defined, meaning that only one major enzyme component is present. This can be inferred e.g. by fractionation on an appropriate size-exclusion column. Such well-defined, or purified, or highly purified, enzyme can be obtained as is known in the art and/or described in publications relating to the specific enzyme in question.

A peroxidase according to the invention is a peroxidase enzyme comprised by the enzyme classification EC 1.11.1.7, or any fragment derived therefrom, exhibiting peroxidase activity.

Preferably, the peroxidase according to the invention is a plant peroxidase e.g. soybean peroxidase (see SEQ ID NO:2), or a fungal or bacterial peroxidase.

Some preferred fungi include strains belonging to the subdivision Deuteromycotina, class Hyphomycetes, e.g., *Fusarium, Humicola, Tricoderma, Myrothecium, Verticillum, Arthromyces, Caldariomyces, Ulocladium, Embellisia, Cladosporium* or *Dreschlera*, in particular *Fusarium oxysporum* (DSM 2672), *Humicola insolens, Trichoderma reesei, Myrothecium verrucaria* (IFO 6113), *Verticillum alboatrum, Verticillum dahlie, Arthromyces ramosus* (FERM P-7754), *Caldariomyces fumago, Ulocladium chartarum, Embellisia alli* or *Dreschlera halodes*.

Other preferred fungi include strains belonging to the subdivision Basidiomycotina, class Basidiomycetes, e.g., *Coprinus, Phanerochaete, Coriolus* or *Trametes*, in particular *Coprinus cinereus* f. *microsporus* (IFO 8371), *Coprinus macrorhizus, Phanerochaete chrysosporium* (e.g. NA-12) or *Trametes* (previously called *Polyporus*), e.g., *T. versicolor* (e.g. PR4 28-A).

Further preferred fungi include strains belonging to the subdivision Zygomycotina, class Mycoraceae, e.g., *Rhizopus* or *Mucor*, in particular *Mucor hiemalis*.

Some preferred bacteria include strains of the order Actinomycetales, e.g. *Streptomyces spheroides* (ATTC 23965), *Streptomyces thermoviolaceus* (IFO 12382) or *Streptoverticillum verticillium* ssp. *verticillium*.

Other preferred bacteria include *Rhodobacter sphaeroides, Rhodomonas palustri, Streptococcus lactis, Pseudomonas purrocinia* (ATCC 15958), *Pseudomonas fluorescens* (NRRL B-11) and *Bacillus* strains, e.g. *Bacillus pumilus* (ATCC 12905) and *Bacillus stearothermophilus*.

Further preferred bacteria include strains belonging to *Myxococcus*, e.g., *M. virescens*.

The peroxidase may furthermore be one which is producible by a method comprising cultivating a host cell transformed with a recombinant DNA vector which carries a DNA sequence encoding said peroxidase as well as DNA sequences encoding functions permitting the expression of the DNA sequence encoding the peroxidase, in a culture medium under conditions permitting the expression of the peroxidase and recovering the peroxidase from the culture.

Particularly, a peroxidase of the present invention is a peroxidase derived from a *Coprinus* sp. (also referred to as *Coprinopsis* sp.), in particular *C. macrorhizus* or *C. cinereus* (see e.g. SEQ ID NO:1).

In a preferred embodiment, the peroxidase of the methods and compositions of the invention comprises or consists of an amino acid sequence with a substitution, deletion, and/or insertion of one or more (or several) amino acids of the polypeptide of SEQ ID NO: 1 or 2, or a homologous sequence thereof. Preferably, the homologous sequence is at least 80% identity, such as at least 85% identity, at least 90% identity or at least 95% identity, to SEQ ID NO:1 or SEQ ID NO:2.

For purposes of the present invention, the degree of sequence identity between two amino acid sequences is determined using the Needleman-Wunsch algorithm (Needleman and Wunsch, 1970, *J. Mol. Biol.* 48: 443-453) as implemented in the Needle program of the EMBOSS package (EMBOSS: The European Molecular Biology Open Software Suite, Rice et al., 2000, *Trends Genet.* 16: 276-277), preferably version 3.0.0 or later. The optional parameters used are gap open penalty of 10, gap extension penalty of 0.5, and the EBLOSUM62 (EMBOSS version of BLOSUM62) substitution matrix. The output of Needle labeled "longest identity" (obtained using the—nobrief option) is used as the percent identity and is calculated as follows:

$$(\text{Identical Residues} \times 100)/(\text{Length of Alignment} - \text{Total Number of Gaps in Alignment})$$

For purposes of the present invention, the degree of sequence identity between two deoxyribonucleotide sequences is determined using the Needleman-Wunsch algorithm (Needleman and Wunsch, 1970, supra) as implemented in the Needle program of the EMBOSS package (EMBOSS: The European Molecular Biology Open Software Suite, Rice et al., 2000, supra), preferably version 3.0.0 or later. The optional parameters used are gap open penalty of 10, gap extension penalty of 0.5, and the EDNAFULL (EMBOSS version of NCBI NUC4.4) substitution matrix.

The output of Needle labeled "longest identity" (obtained using the—nobrief option) is used as the percent identity and is calculated as follows:

(Identical Deoxyribonucleotides×100)/(Length of Alignment−Total Number of Gaps in Alignment)

In the present invention, the polypeptide sequence of the peroxidase can be variants comprising a substitution, deletion, and/or insertion of one or more (or several) amino acids of the polypeptide of SEQ ID NO: 1 or 2, or a homologous sequence thereof. Preferably, amino acid changes (i.e. substitution, deletion, and/or insertion of one or more (or several) amino acids) are of a minor nature, that is conservative amino acid substitutions or insertions that do not significantly affect the folding and/or activity of the protein; small deletions, typically of one to about 30 amino acids; small amino or carboxyl-terminal extensions, such as an amino-terminal methionine residue; a small linker peptide of up to about 20-25 residues; or a small extension that facilitates purification by changing net charge or another function, such as a poly-histidine tract, an antigenic epitope or a binding domain.

Examples of conservative substitutions are within the group of basic amino acids (arginine, lysine and histidine), acidic amino acids (glutamic acid and aspartic acid), polar amino acids (glutamine and asparagine), hydrophobic amino acids (leucine, isoleucine and valine), aromatic amino acids (phenylalanine, tryptophan and tyrosine), and small amino acids (glycine, alanine, serine, threonine and methionine). Amino acid substitutions that do not generally alter specific activity are known in the art and are described, for example, by H. Neurath and R. L. Hill, 1979, *In, The Proteins*, Academic Press, New York. The most commonly occurring exchanges are Ala/Ser, Val/Ile, Asp/Glu, Thr/Ser, Ala/Gly, Ala/Thr, Ser/Asn, Ala/Val, Ser/Gly, Tyr/Phe, Ala/Pro, Lys/Arg, Asp/Asn, Leu/Ile, Leu/Val, Ala/Glu, and Asp/Gly.

Essential amino acids in a parent polypeptide can be identified according to procedures known in the art, such as site-directed mutagenesis or alanine-scanning mutagenesis (Cunningham and Wells, 1989, *Science* 244: 1081-1085). In the latter technique, single alanine mutations are introduced at every residue in the molecule, and the resultant mutant molecules are tested for endoglucanse activity to identify amino acid residues that are critical to the activity of the molecule. See also, Hilton et al., 1996, *J. Biol. Chem.* 271: 4699-4708. The active site of the enzyme or other biological interaction can also be determined by physical analysis of structure, as determined by such techniques as nuclear magnetic resonance, crystallography, electron diffraction, or photoaffinity labeling, in conjunction with mutation of putative contact site amino acids. See, for example, de Vos et al., 1992, *Science* 255: 306-312; Smith et al., 1992, *J. Mol. Biol.* 224: 899-904; Wlodaver et al., 1992, *FEBS Lett.* 309: 59-64. The identities of essential amino acids can also be inferred from analysis of identities with polypeptides that are related to the parent polypeptide.

Single or multiple amino acid substitutions, deletions, and/or insertions can be made and tested using known methods of mutagenesis, recombination, and/or shuffling, followed by a relevant screening procedure, such as those disclosed by Reidhaar-Olson and Sauer, 1988, *Science* 241: 53-57; Bowie and Sauer, 1989, *Proc. Natl. Acad. Sci. USA* 86: 2152-2156; WO 95/17413; or WO 95/22625. Other methods that can be used include error-prone PCR, phage display (e.g., Lowman et al., 1991, *Biochemistry* 30: 10832-10837; U.S. Pat. No. 5,223,409; WO 92/06204), and region-directed mutagenesis (Derbyshire et al., 1986, *Gene* 46: 145; Ner et al., 1988, *DNA* 7: 127).

Mutagenesis/shuffling methods can be combined with high-throughput, automated screening methods to detect activity of cloned, mutagenized polypeptides expressed by host cells (Ness et al., 1999, *Nature Biotechnology* 17: 893-896). Mutagenized DNA molecules that encode active polypeptides can be recovered from the host cells and rapidly sequenced using standard methods in the art. These methods allow the rapid determination of the importance of individual amino acid residues in a polypeptide.

Preferably, the total number of amino acid substitutions, deletions and/or insertions of the polypeptide of SEQ ID NO: 1 or 2 is not more than 10, e.g., 1, 2, 3, 4, 5, 6, 7, 8 or 9.

The polypeptide may be hybrid polypeptide in which a portion of one polypeptide is fused at the N-terminus or the C-terminus of a portion of another polypeptide.

The polypeptide may be a fused polypeptide or cleavable fusion polypeptide in which another polypeptide is fused at the N-terminus or the C-terminus of the polypeptide of the present invention. A fused polypeptide is produced by fusing a polynucleotide encoding another polypeptide to a polynucleotide of the present invention. Techniques for producing fusion polypeptides are known in the art, and include ligating the coding sequences encoding the polypeptides so that they are in frame and that expression of the fused polypeptide is under control of the same promoter(s) and terminator. Fusion proteins may also be constructed using intein technology in which fusions are created post-translationally (Cooper et al., 1993, *EMBO J.* 12: 2575-2583; Dawson et al., 1994, *Science* 266: 776-779).

A fusion polypeptide can further comprise a cleavage site between the two polypeptides. Upon secretion of the fusion protein, the site is cleaved releasing the two polypeptides. Examples of cleavage sites include, but are not limited to, the sites disclosed in Martin et al., 2003, *J. Ind. Microbiol. Biotechnol.* 3: 568-576; Svetina et al., 2000, *J. Biotechnol.* 76: 245-251; Rasmussen-Wilson et al., 1997, *Appl. Environ. Microbiol.* 63: 3488-3493; Ward et al., 1995, *Biotechnology* 13: 498-503; and Contreras et al., 1991, *Biotechnology* 9: 378-381; Eaton et al., 1986, *Biochemistry* 25: 505-512; Collins-Racie et al., 1995, *Biotechnology* 13: 982-987; Carter et al., 1989, *Proteins: Structure, Function, and Genetics* 6: 240-248; and Stevens, 2003, Drug Discovery World 4: 35-48.

Source of Hydrogen Peroxide

The source of hydrogen peroxide required by the peroxidase, or compounds exhibiting peroxidase activity, may be provided as an aqueous solution of hydrogen peroxide or a hydrogen peroxide precursor for in situ production of hydrogen peroxide. Any solid entity which liberates upon dissolution a peroxide which is useable by peroxidase can serve as a source of hydrogen peroxide. Compounds which yield hydrogen peroxide upon dissolution in water or an appropriate aqueous based medium include but are not limited to metal peroxides, percarbonates, persulphates, perphosphates, peroxyacids, alkyperoxides, acylperoxides, peroxyesters, urea peroxide, ozone, perborates and peroxycarboxylic acids or salts thereof.

Another source of hydrogen peroxide is a hydrogen peroxide generating enzyme system, such as an oxidase together with a substrate for the oxidase. Examples of combinations of oxidase and substrate comprise, but are not limited to, amino acid oxidase (see e.g. U.S. Pat. No. 6,248,575) and a suitable amino acid, glucose oxidase (see e.g. WO 95/29996) and glucose, lactate oxidase and lactate, galactose oxidase (see e.g. WO 00/50606) and galactose, and aldose oxidase (see e.g. WO 99/31990) and a suitable aldose.

By studying EC 1.1.3.-, EC 1.2.3.-, EC 1.4.3.-, and EC 1.5.3.- or similar classes (under the International Union of Biochemistry), other examples of such combinations of oxidases and substrates are easily recognized by one skilled in the art.

Mediator

The mediators according to the invention act as electron donors for the peroxidase. The mediator compounds improve the electron transfer between the peroxidase and the textile to improve the bleaching effect of the methods of the invention. The mediators according to the invention have the chemical structure:

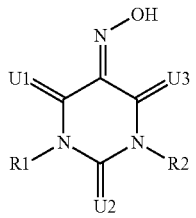

wherein U1, U2 and U3 are identical or different, and are O, S or NOH; and R1 and R2 are identical or different, and are hydrogen, hydroxyl, formyl, carbamoyl or sulfono radical, ester or salt of the sulfono radical, sulfamoyl, nitro, nitroso, amino, cyano, phenyl, benzyl, $C_1$-$C_4$-alkyl, $C_1$-$C_4$-alkoxy, $C_1$-$C_4$-carbonyl, carbonyl-$C_1$-$C_4$-alkyl.

In an embodiment, U1, U2 and U3 are identical or different, and are O or S; and R1 and R2 are identical or different, and are hydrogen, hydroxyl, formyl, carbamoyl or sulfono radical, ester or salt of the sulfono radical, sulfamoyl, nitro, nitroso, amino, cyano, phenyl, benzyl, $C_1$-$C_4$-alkyl, $C_1$-$C_4$-alkoxy, $C_1$-$C_4$-carbonyl, carbonyl-$C_1$-$C_4$-alkyl.

In another embodiment, U1, U2 and U3 are O; and R1 and R2 are identical or different, and are hydrogen, hydroxyl, formyl, carbamoyl or sulfono radical, ester or salt of the sulfono radical, sulfamoyl, nitro, nitroso, amino, cyano, phenyl, benzyl, $C_1$-$C_4$-alkyl, $C_1$-$C_4$-alkoxy, $C_1$-$C_4$-carbonyl, carbonyl-$C_1$-$C_4$-alkyl.

In another embodiment, U1, U2 and U3 are identical or different, and are O, S or NOH; and R1 and R2 are identical or different, and are hydrogen, hydroxyl, methyl, ethyl, phenyl, benzyl, formyl, amino, cyano, nitroso, methoxy and/or ethoxy.

In another embodiment, U1, U2 and U3 are identical or different, and are O or S; and R1 and R2 are identical or different, and are hydrogen, hydroxyl, methyl, ethyl, phenyl, benzyl, formyl, amino, cyano, nitroso, methoxy and/or ethoxy.

In another embodiment, U1, U2 and U3 are O; and R1 and R2 are identical or different, and are hydrogen, hydroxyl, methyl, ethyl, phenyl, benzyl, formyl, amino, cyano, nitroso, methoxy and/or ethoxy.

Preferred mediators are 1-methylvioluric acid, 1,3-dimethylvioluric acid, thiovioluric acid and violuric acid or their hydrates.

A particularly preferred mediator is alloxan-5-oxime (violuric acid) and/or its esters, ethers or salts or hydrates.

Textile

As used herein, the term "textile" refers to fibers, yarns, fabrics, garments, and non-wovens. The term encompasses textiles made from natural, synthetic (e.g., manufactured), and various natural and synthetic blends. Textiles may be unprocessed or processed fibers, yarns, woven or knit fabrics, non-wovens, and garments and may be made using a variety of materials, some of which are mentioned, herein.

The process of the invention is most beneficially applied to cellulose-containing fabrics, such as cotton, viscose, rayon, ramie, linen, Tencel, or mixtures thereof, or mixtures of any of these fibres, or mixtures of any of these fibres together with synthetic fibres such as mixtures of cotton and spandex (stretch-denim). In particular, the fabric is dyed fabric, preferably is denim. The denim fabric may be dyed with vat dyes such as indigo, or indigo-related dyes such as thioindigo.

In a most preferred embodiment of the process of the invention, the fabric is indigo-dyed denim, including clothing items manufactured therefrom.

Textile Manufacturing Process

The processing of a fabric, such as of a cellulosic material, into material ready for garment manufacture involves several steps: spinning of the fiber into a yarn; construction of woven or knit fabric from the yarn; and subsequent preparation processes, dyeing/printing and finishing operations. Preparation processes are necessary for removing natural and man-induced impurities from fibers and for improving their aesthetic appearance and processability prior to for instance dyeing/printing and finishing. Common preparation processes comprise desizing (for woven goods), scouring, and bleaching, which produce a fabric suitable for dyeing or finishing.

Woven fabric is constructed by weaving "filling" or "weft" yarns between warp yarns stretched in the longitudinal direction on the loom. The warp yarns must be sized before weaving in order to lubricate and protect them from abrasion at the high speed insertion of the filling yarns during weaving. Common size agents are starches (or starch derivatives and modified starches), poly(vinyl alcohol), carboxyl methyl cellulose (i.e. CMC) where starches are dominant. Paraffin, acrylic binders and variety of lubricants are often included in the size mix. The filling yarn can be woven through the warp yarns in a "over one—under the next" fashion (plain weave) or by "over one—under two" (twill) or any other myriad of permutations. Generally, dresses, shirts, pants, sheeting's, towels, draperies, etc. are produced from woven fabric. After the fabric is made, size on the fabric must be removed again (i.e. desizing).

Knitting is forming a fabric by joining together interlocking loops of yarn. As opposed to weaving, which is constructed from two types of yarn and has many "ends", knitted fabric is produced from a single continuous strand of yarn. As with weaving, there are many different ways to loop yarn together and the final fabric properties are dependent both upon the yarn and the type of knit. Underwear, sweaters, socks, sport shirts, sweat shirts, etc. are derived from knit fabrics.

Desizing

Desizing is the degradation and/or removal of sizing compounds from warp yarns in a woven fabric. Starch is usually removed by an enzymatic desizing procedure. In addition, oxidative desizing and chemical desizing with acids or bases are sometimes used.

In some embodiments, the desizing enzyme is an amylolytic enzyme, such as an alpha-amylase, a beta-amylase, a mannanase, a glucoamylase, or a combination thereof.

Suitable alpha and beta-amylases include those of bacterial or fungal origin, as well as chemically or genetically modified mutants and variants of such amylases. Suitable alpha-amylases include alpha-amylases obtainable from *Bacillus* species. Suitable commercial amylases include but are not limited to OPTISIZE® NEXT, OPTISIZE® FLEX and OPTISIZE® COOL (all from Genencor International Inc.), and DURAMYL™, ERMAMYL™, FUNGAMYL™ TERMAMYL™, AQUAZYME™ and BAN™ (all available from Novozymes A/S, Bagsvaerd, Denmark).

Other suitable amylolytic enzymes include the CGTases (cyclodextrin glucanotransferases, EC 2.4.1.19), e.g., those obtained from species of *Bacillus, Thermoanaerobactor* or *Thermoanaero-bacterium.*

Scouring

Scouring is used to remove impurities from the fibers, to swell the fibers and to remove seed coat. It is one of the most critical steps. The main purposes of scouring is to a) uniformly clean the fabric, b) soften the motes and other trashes, c) improve fabric absorbency, d) saponify and solubilize fats, oils, and waxes, and e) minimize immature cotton. Sodium hydroxide scouring at about boiling temperature is the accepted treatment for 100% cotton, while calcium hydroxide and sodium carbonate are less frequently used. Synthetic fibers are scoured at much milder conditions. Surfactant and chelating agents are essential for alkaline scouring. Enzymatic scouring has been introduced, wherein cellulase, hemicellulase, pectinase, lipase, and protease are all reported to have scouring effects.

Bleaching

Bleaching is the destruction of pigmented color and/or colored impurities as well as seed coat fragment removal. It is the most critical chemical treatment since a balance between the degrees of whiteness without fiber damage must be maintained. Bleaching is performed by the use of oxidizing or reducing chemistry. Oxidizing agents can be further subdivided into those that employ or generate: a) hypochlorite ($OCl^-$), b) chloride dioxide ($ClO_2$), and hydroperoxide species ($OOH^-$ and/or OOH). Reducing agents are typical sulfur dioxide, hydrosulfite salts, etc. Enzymatic bleaching using glucose oxidase has been reported. Traditionally, hydrogen peroxide is used in this process.

Printing and Dyeing

Printing and dyeing of textiles is carried out by applying dyes to the textile by any appropriate method for binding the dyestuff to the fibres in the textiles. The dyeing of textiles is for example carried out by passing the fabric through a concentrated solution of dye, followed by storage of the wet fabric in a vapour tight enclosure to permit time for diffusion and reaction of the dye with the fabric substrate prior to rinsing off un-reacted dye. Alternatively, the dye may be fixed by subsequent steaming of the textile prior to rinsing. The dyes include synthetic and natural dyes. Typical dyes are those with anionic functional groups (e.g. acid dyes, direct dyes, Mordant dyes and reactive dyes), those with cationic groups (e.g. basic dyes), those requiring chemical reaction before application (e.g. vat dyes, sulphur dyes and azoic dyes), disperse dyes and solvent dyes.

Excess soluble dyestuff not bound to the fibres must be removed after dyeing to ensure fastness of the dyed textiles and to prevent unwanted dye transfer during laundering of the textiles by the consumer. Generally, a large amount of water is required for complete removal of excess dye. In a conventional process, the printed or dyed textile is first rinsed with cold water, then washed at high temperature with the addition of a suitable additive to decrease back-staining, like poly(vinylpyrrolidone) (PVP).

An enzymatic process for removal of excess dye from dyed fabric with a rinse liquor comprising at least one peroxidase, an oxidase agent and at least one mediator, such as liquor comprising a peroxidase, hydrogen peroxidise and a mediator like 1-hydroxy-benzotriazole is disclosed in WO99/34054.

Biopolishing

As used herein, the term "biopolishing", "depilling" and "anti-pilling" are interchangeable.

Most cotton fabrics and cotton blend fabrics have a handle appearance that is rather hard and stiff without the application of finishing components. The fabric surface also is not smooth because small fuzzy microfibrils protrude from it. In addition, after a relatively short period of wear, pilling appears on the fabric surface thereby giving it an unappealing, worn look.

Biopolishing is a method to treat cellulosic fabrics during their manufacture by enzymes such as cellulases, which improves fabric quality with respect to "reduced pilling formation". The most important effects of biopolishing can be characterized by less fuzz and pilling, increased gloss/luster, improved fabric handle, increased durable softness and/or improved water absorbency. Biopolishing usually takes place in the wet processing of the manufacture of knitted and woven fabrics or garments. Wet processing comprises such steps as e.g., desizing, scouring, bleaching, washing, dying/printing and finishing. Biopolishing could be performed as a separate step after any of the wetting steps or in combination with any of those wetting steps.

Manufacturing of Denim Fabric

Some dyed fabric such as denim fabric, requires that the yarns are dyed before weaving. For denim fabric, the warp yarns are dyed for example with indigo, and sized, before weaving. Preferably the dyeing of the denim yarn is a ring-dyeing. A preferred embodiment of the invention is ring-dyeing of the yarn with a vat dye such as indigo, or an indigo-related dye such as thioindigo, or a sulfur dye, or a direct dye, or a reactive dye, or a naphthol. The yarn may also be dyed with more than one dye, e.g., first with a sulphur dye and then with a vat dye, or vice versa.

Preferably, the yarns undergo scouring and/or bleaching before they are dyed, in order to achieve higher quality of denim fabric. In general, after woven into dyed fabric, such as denim, the dyed fabric or garment proceeds to a desizing stage, preferably followed by a biostoning step and/or a color modification step.

The desizing process as used herein is the same process as mentioned above in the text.

After desizing, the dyed fabric undergoes a biostoning step. The biostoning step can be performed with enzymes or pumice stones or both. As used herein, the term "biostoning", "stone washing" and "abrasion" are interchangeable, which means agitating the denim in an aqueous medium containing a mechanical abrasion agent such as pumice, an abrading cellulase or a combination of these, to provide a "stone-washed" look. In all cases, mechanical action is needed to remove the dye, and the treatment is usually carried out in washing machines, like drum washers, belly washers. As a result of uneven dye removal there are contrasts between dyed areas and areas from which dye has been removed. Treatment with cellulase can completely replace treatment with pumice stones. However, cellulase treatment can also be combined with pumice stone treatment, when it is desired to produce a heavily abraded finish.

Preferably, the abrasion is followed by a color modification step. As used herein, the terms "color modification" or "color adjustment" are used without distinction to refer to any change to the color of a textile resulting from the destruction, modification, or removal of a dyestuff associated with the textile. Without being limited to a theory, it is proposed that color modification results from the modification of chromaphores associated with a textile material, thereby changing its visual appearance. The chromophores may be naturally-associated with the material used to manufacture a textile (e.g., the white color of cotton) or associated with special finishes, such as dying or printing. Color modification encompasses chemical modification to a chromophore as well as chemical modification to the material to which a chromophore is attached.

Examples of color modification include but are not limited to, bleaching, reduction of redeposition/backstaining, fading, imparting a grey cast, altering hue, saturation, or luminescence, and the like. The amount and type of color modification can be determined by comparing the color of a textile following enzymatic treatment with a perhydrolase enzyme (i.e., residual color) to the color of the textile prior to enzymatic treatment (i.e., original color) using known spectrophotometric or visual inspection methods.

In the present invention, a method for modifying the color of a textile product involves contacting the textile with a peroxidase, a source of hydrogen peroxide, and a mediator. In some embodiments, the textile is contacted with a peroxidase, a source of hydrogen peroxide, and a mediator in an aqueous solution.

Getting faded or bleached look in certain areas on textile especially denim, is an important part in textile manufacturing. This is normally achieved by applying $KMnO_4$ (or $KMnO_4/H_3PO_4$) solution (via brushing, rubbing or spray) onto dried denim after abrasion step. The stained area would get bleached after drying and washing with $Na_2S_2O_5$ solution. During this process indigo/sulphur dyes are destroyed by $KMnO_4$ through oxidation, and then $Na_2S_2O_5$ washing is applied to get rid of the brown colour caused by products of the oxidation. Such treatment will form a local color modification, i.e. a specific bleached pattern on denim to meet the customers' needs.

The composition of the present invention could also achieve a specific bleached pattern on denim through a simple 'rub-wash' way, i.e. applying the mixture of a peroxidase and a mediator as defined in the present invention onto dry denim, after washing with $H_2O_2$ bath the treated area would turn out bleached.

For the purpose of the present invention, "color modification" is measured by the bleaching level on the front side of the textile. This bleaching level indicates the production of a brighter and/or whiter textile, e.g., in the context of a textile processing application, as well as lightening of the color of a stain, e.g., in the context of a cleaning application.

In some embodiments, the bleaching level on the front side of the textile is measured under protocol as specified in Example 1, by treatment with a peroxidase, a source of hydrogen peroxide, and a mediator as defined in the present invention, at 55° C., pH 5.0 for 30 minutes and peroxidase dosage of 0.015 mg enzyme protein/g fabric, mediator dosage of 0.5 mM/L and hydrogen peroxide dosage of 0.05 g/L in an aqueous solution. As used herein, the hydrogen peroxide dosage refers to the dosage of hydrogen peroxide added during the process, or the source of hydrogen peroxide added in an amount which will generate hydrogen peroxide at the level of 0.05 g/L. In a preferred embodiment, under such testing conditions as specified in Example 1, the method or the composition of the present invention show the color modification with the bleaching level on the front side of at least 1.5 Delta L* unit, more preferably at least 1.6, more preferably at least 1.7, more preferably at least 1.8, more preferably at least 1.9, more preferably at least 2, more preferably at least 2.1, more preferably at least 2.2, more preferably at least 2.3, more preferably at least 2.4, more preferably at least 2.5, more preferably at least 2.6, even more preferably at least 2.7, even more preferably at least 2.8, even more preferably at least 2.9, even most preferably at least 3 Delta L* unit. Delta L* unit is defined in the material and method section under colour measurement.

According to the present invention, the color modification on the back side of the textile is defined as bleaching level of Delta b* unit. Since the dyestuff on the back side of the textile is generally in a small amount, the color modification on the back side of the dyed textile is not easily detectable. In some embodiments, the bleaching level on the back side of the textile is measured under protocol as specified in Example 1, by treatment with a peroxidase, a source of hydrogen peroxide, and a mediator as defined in the present invention, at 55° C., pH 5.0 for 30 minutes and peroxidase dosage of 0.015 mg enzyme protein/g fabric, mediator dosage of 0.5 mM/L and hydrogen peroxide dosage of 0.05 g/L in an aqueous solution, wherein preferably, such method or the composition of the present invention shows the color modification on the back side with the bleaching level of Delta b* unit >0. Delta b* unit is defined in the material and method section under colour measurement.

Additional Enzymes

It will be appreciated that one or more cellulase, perhydrolase, laccase, amylase, lipase, mannanase, amylase, protease, oxidase, catalase or other enzyme mentioned, herein, may be used as additional enzyme in the present compositions and methods. Moreover, any number of additional enzymes (or enzyme systems) can be combined with the present compositions and methods without defeating the spirit of the disclosure.

The protease may for example be a metalloprotease (EC 3.4.17 or EC 3.4.24) or a serine protease (EC 3.4.21), preferably an alkaline microbial protease or a trypsin-like protease. Examples of proteases are subtilisins (EC 3.4.21.62), especially those derived from *Bacillus*, e.g., subtilisin Novo, subtilisin Carlsberg, subtilisin 309, subtilisin 147 and subtilisin 168 (described in WO 89/06279). Examples of trypsin-like proteases are trypsin (e.g., of porcine or bovine origin) and the *Fusarium* protease described in WO 89/06270 and WO 94/25583.

The term "cellulase" refers to an enzyme which catalyses the degradation of cellulose to glucose, cellobiose, triose and other cello-oligosaccharides. Cellulase includes those usually identified as, e.g., cellobiohydrolases, endoglucanases, and beta-glucosidases. Examples of commercially available cellulase enzyme products useful in the method of the present invention are: Cellusoft®' Celluclast®, Denimax® Acid, Denimax® Ultra (all available from Novozymes A/S, Bagsvaerd, Denmark); Indiage™, Primafast™ (both from Genencor International Inc., U.S.A.); Powerstone™ (from Iogen, Canada) and Ecostone™, Biotouch™ (both from AB Enzymes, Finland).

A "perhydrolase" is an enzyme capable of catalyzing a perhydrolysis reaction that results in the production of a sufficiently high amount of peracid for use in an oxidative dye decolorization method as described. Generally, the perhydrolase enzyme exhibits a high perhydrolysis to hydrolysis ratio. In some embodiments, the perhydrolase enzyme is a naturally occurring *Mycobacterium smegmatis* perhydrolase enzyme or a variant thereof. This enzyme, its enzymatic properties, its structure, and numerous variants and homologs, thereof, are described in detail in International Patent Application Publications WO 05/056782A and WO 08/063400A and U.S. Patent Application Publications US2008145353 and US2007167344, which are incorporated by reference.

A "laccase" is a multi-copper containing oxidase (EC 1.10.3.2) that catalyzes the oxidation of phenols, polyphenols, and anilines by single-electron abstraction, with the concomitant reduction of oxygen to water in a four-electron transfer process. Examples of commercially available laccase enzyme products useful in the method of the present invention are: EcoFade LT100 (available Genencor International Inc., U.S.A.) and Novoprime Base 268 (available Novozymes A/S).

Method of the Invention

In the present invention, the method of treating textile by contacting a textile with a peroxidase, a source of hydrogen peroxide, and a mediator is provided.

It is at present advised that a suitable liquor/textile ratio to be used in the present method may be in the range of from about 20:1 to about 1:1, preferably in the range of from about 15:1 to about 3:1, more preferably in the range of from 15:1 to 5:1 (volumn/weight).

The reaction time is usually in the range of from about 1 minute to about 5 hours. Preferably the reaction time is within the range of from about 3 minutes to about 180 minutes, more preferably the reaction time is within the range of from about 5 minutes to about 60 minutes, even more preferably within 5 to 30 minutes, and most preferably 10-30 minutes.

The process of the present invention is carried out at a pH of from about 2 to about 8, preferably at a pH from about 3 to about 7, more preferably at a pH from about 4 to about 7, even more preferably at a pH from about 4 to about 6, and most preferably at a pH from about 4 to about 5.

The process of the present invention is able to function at a temperature below 90° C., preferably below 75° C., more preferably below 65° C., more preferably below 60° C., more preferably below 55° C., more preferably below 45° C., even more preferably below 35° C.

In some embodiments, the process of the present invention is conducted at the temperature range of 10-90° C., preferably 15-80° C., more preferably 20-70° C., more preferably 30-70° C., more preferably 35-65° C., and even more preferably 30-50° C.

Enzyme dosage greatly depends on the enzyme reaction time and enzyme activity, i.e. a relatively short enzymatic reaction time or low enzymatic activity necessitates a relatively increased enzyme dosage, and vice versa. In general, enzyme dosage may be stipulated in accordance with the reaction time available.

In a particular embodiment, the dosage of the peroxidase and additional enzymes, if any, is from about 0.0001 milligram (mg) enzyme protein to about 10 mg enzyme protein (of each enzyme) per gram of fabric, preferably 0.0005 mg enzyme protein to 5 mg enzyme protein per gram of fabric, more preferably 0.0008 mg enzyme protein to 3 mg enzyme protein per gram of fabric, more preferably 0.001 mg enzyme protein to 2 mg enzyme protein per gram of fabric, more preferably 0.001 mg enzyme protein to 1 mg enzyme protein per gram of fabric, more preferably 0.001 mg enzyme protein to 0.5 mg enzyme protein per gram of fabric, even more preferably 0.001 mg enzyme protein to 0.1 mg enzyme protein per gram of fabric. Again, these amounts refer to the amount of each enzyme.

According to the invention, the mediator may be present in a concentration in the range of from 0.01 mM to 100 mM, preferably in the range of from 0.02 mM to 50 mM, more preferably in the range of from 0.05 mM to 10 mM, and even more preferably in the range of from 0.05 mM to 5 mM, and even more preferably in the range of from 0.1 mM to 1 mM, and most preferably in the range of from 0.1 mM to 0.5 mM.

Source of hydrogen peroxide may be added at the beginning of or during the process, e.g., typically in an amount corresponding to levels of from 0.001 mM to 25 mM, preferably to levels of from 0.005 mM to 5 mM, and particularly to levels of from 0.01 to 1 mM hydrogen peroxide, and more particularly to levels of from 0.01 to 0.5 mM hydrogen peroxide. As used herein, the dosage of the source of hydrogen peroxide refers to the amount of hydrogen peroxide added, or the source of hydrogen peroxide added in an amount which will generate hydrogen peroxide at the level of the indicated ranges.

Molecular oxygen from the atmosphere will usually be present in sufficient quantity, if required. Therefore, the reaction may conveniently be carried out in an open reactor, i.e. at atmospheric pressure.

Various additives over and above the peroxidase and additional enzymes, if any, can be used in the process of the invention. Surfactants and/or dispersants are often present in, and/or added to a textile. Thus the process and use of the present invention may be carried out in the presence of an anionic, non-ionic, cationic and/or zwitterionic surfactant and/or dispersant conventionally used in textile processsing. Examples of anionic surfactants are carboxylates, sulphates, sulphonates or phosphates of alkyl, substituted alkyl or aryl. Examples of non-ionic surfactants are polyoxyethylene compounds, such as alcohol ethoxylates, propoxylates or mixed ethoxy-/propoxylates, poly-glycerols and other polyols, as well as certain block-copolymers. Examples of cationic surfactants are water-soluble cationic polymers, such as quartenary ammonium sulphates and certain amines, e.g. epichlorohydrin/dimethylamine polymers (EPI-DMA) and cross-linked solutions thereof, polydiallyl dimethyl ammonium chloride (DADMAC), DADMAC/Acrylamide co-polymers, and ionene polymers, such as those disclosed in U.S. Pat. Nos. 5,681,862; and 5,575,993. Examples of zwitterionic or amphoteric surfactants are betains, glycinates, amino propionates, imino propionates and various imidazolin-derivatives. Also the polymers disclosed in U.S. Pat. No. 5,256,252 may be used.

In the process of the invention, the peroxidase may be applied alone or together with an additional enzyme. The term "an additional enzyme" means at least one additional enzyme, e.g. one, two, three, four, five, six, seven, eight, nine, ten or even more additional enzymes.

The term "applied together with" (or "used together with") means that the additional enzyme may be applied in the same, or in another step of the process of the invention. The other process step may be upstream or downstream in the textile manufacturing process, as compared to the step in which the textile is treated with a peroxidase.

In particular embodiments the additional enzyme is an enzyme which has protease, lipase, xylanase, cutinase, oxidoreductase, cellulase, endoglucanase, amylase, and/or mannanase. Examples of oxidoreductase enzymes are enzymes with laccase, perhydrolase, and/or peroxidase activity. In a preferred embodiment, the additional enzyme is laccase.

In some embodiments, the method for treating textile comprises (a) contacting the textile with cellulase; (b) contacting a textile with a peroxidase, a source of hydrogen peroxide, and a mediator. In some embodiments, between step (a) and (b), there is a wash step. In some embodiments, (a) and (b) are performed in a single bath without intervening wash steps. In some embodiments, (a) and (b) are performed sequentially or simultaneously in the same bath. In some embodiments, (a) and (b) are performed sequentially in a single bath, wherein (a) is performed prior to the (b).

In some embodiments, (a) is preceded by an enzymatic desizing step. In some embodiments, the enzymatic desizing step may be performed in the same bath as (a). In some embodiments, the enzymatic desizing step is performed sequentially or simultaneously in the same bath as (a) and (b). In some embodiments, the enzymatic desizing step is performed sequentially in the same bath as (a) and (b), wherein the order of the steps is enzymatic desizing, step (a) and (b). In some embodiments, the enzymatic desizing step is performed in one bath, followed by a wash step, and step (a) and (b) performed in the same bath.

Peroxidases can also be used in other aspects of textile manufacturing, generally including aspects of treatment, processing, finishing, polishing, production of fibers, or the like. In addition to modifying the color of denim, peroxidases can be used in de-coloring dyed waste (including indigo-dyed waste), in fabric dyeing, in textile bleaching, in fiber modification; in achieving enhanced fiber or fabric properties, and the like.

The present composition or process may also be applied in textile bleaching to destruct pigmented color and/or colored impurities of cotton fabric. In some embodiments, the step of applying a peroxidase, a source of hydrogen peroxide and a mediator to destruct pigmented color and/or colored impurities of cotton fabric is performed after the scouring step.

In further embodiments, the present compositions may also be used in a method for modifying the color of wool.

The present compositions may also be used in a method to remove excess dye after dyeing/printing step. Excess soluble dyestuff not bound to the fibres can be removed by applying the present composition after dyeing, to ensure fastness of the dyed textiles and to prevent unwanted dye transfer during laundering of the textiles by the consumer.

The present compositions may also be used in the field of waste-water treatment. For example, peroxidases can be used in decolorization of colored compounds.

Although mainly exemplified using indigo and sulfur-dyed textiles, the present methods can be applied to modify the color of textiles dyed with a large number of dyes. Examples of dyes include, but are not limited to, azo, monoazo, disazo, nitro, xanthene, quinoline, anthroquinone, triarylmethane, paraazoanyline, azineoxazine, stilbene, aniline, and phthalocyanine dyes, or mixtures thereof. In one embodiment, the dye is an azo dye (e.g., Reactive Black 5 (2,7-naphthalenedisulfonic acid, 4-amino-5-hydroxy-3,6-bis((4-((2-(sulfooxy)ethyl)sulfonyl)phenyl)azo)-tetrasodium salt), Reactive Violet 5, methyl yellow, Congo red). In some embodiments, the dye is an anthraquinone dye (e.g., remazol blue), indigo (indigo carmine), a triarylmethane/paraazoanyline dye (e.g., crystal violet, malachite green), or a sulfur-based dye. In various embodiments, the dye is a reactive, direct, disperse, or pigment dye. In some embodiments, the dye is a component of an ink.

Compositions

As described above, the present compositions include a peroxidase, a source of hydrogen peroxide and a mediator.

Such composition can also be provided in the form of a "ready to use" (RTU) composition comprising, consisting of, or consisting essentially of a peroxidase, a source of hydrogen peroxide and a mediator. In some embodiments, the mediator is selected from 1-methylvioluric acid, 1,3-dimethylvioluric acid, thiovioluric acid, violuric acid, and esters, ethers, salts or hydrates thereof. In some embodiments, the source of hydrogen peroxide is selected from percarbonates, persulphates, perphosphates, peroxyacids, alkyperoxides, acylperoxides, peroxyesters, urea peroxide, perborates and peroxycarboxylic acids or salts thereof. The RTU composition may further contain one or more compounds to provide a pH buffer when the composition is in solution. For example, in some embodiments, the composition contains phosphate buffer or adipic acid buffering system. Preferably the adipic acid buffering system is acetic acid buffering system. The RTU composition may be in a solid, granular form for ease of storage and transportation. The composition is then diluted with water to provide an aqueous solution for use, e.g., as described. RTU compositions may also include any number of additional reagents, such as dispersants, surfactant, blockers, polymers, preservatives, and the like.

Determination of Peroxidase Activity (PDXU)

One peroxidase unit (PDXU) is the amount of enzyme which catalyze the conversion of one μmole hydrogen peroxide per minute at 30° C. in a mixture containing:

0.1 M phosphate buffer, pH 7.0;

0.88 mM hydrogen peroxide; and 1.67 mM 2,2'-azino-bis(3-ethylbenzothiazoline-6-sulfonate) (ABTS).

The reaction is continued for 60 seconds (15 seconds after mixing) while the change in absorbance at 418 nm is measured. The absorbance should be in the range of 0.15 to 0.30. Peroxidase activity is calculated using an absorption coefficient of oxidized ABTS of 36 $mM^{-1}$ $cm^{-1}$, and a stoichiometry of one μmole $H_2O_2$ converted per two μmole ABTS oxidized.

The present methods and compositions are further described in the following numbered paragraphs.

1. A method of treating textile is provided, comprising contacting a textile with a peroxidase, a source of hydrogen peroxide, and a mediator having the chemical structure:

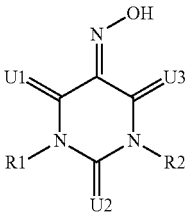

wherein U1, U2 and U3 are identical or different, and are O, S or NOH; and R1 and R2 are identical or different, and are hydrogen, hydroxyl, formyl, carbamoyl or sulfono radical, ester or salt of the sulfono radical, sulfamoyl, nitro, nitroso, amino, cyano, phenyl, benzyl $C_1$-$C_4$-alkyl, $C_1$-$C_4$-alkoxy, $C_1$-$C_4$-carbonyl, or carbonyl-$C_1$-$C_4$-alkyl.

2. In some embodiments of the method of paragraph 1, U1, U2 and U3 are identical or different, and are O or S; and R1 and R2 are identical or different, and are hydrogen, hydroxyl, methyl, ethyl, phenyl, benzyl, formyl, amino, cyano, nitroso, methoxy and/or ethoxy.

3. In some embodiments of the method of any of the preceding paragraphs, U1, U2 and U3 are O; and R1 and R2 are identical or different, and are hydrogen, hydroxyl, methyl, ethyl, phenyl, benzyl, formyl, amino, cyano, nitroso, methoxy and/or ethoxy.

4. In some embodiments of the method of any of the preceding paragraphs, the mediator is selected from 1-methylvioluric acid, 1,3-dimethylvioluric acid, thiovioluric acid, violuric acid, and esters, ethers, salts or hydrates thereof.

5. In some embodiments of the method of any of the preceding paragraphs, the textile is dyed textile, preferably the textile is dyed fabric, more preferable the textile is denim.

6. In some embodiments of the method of any of the preceding paragraphs, the method conducted in an aqueous solution having a pH of from about 2 to about 8, preferably about 3 to about 7, more preferably about 4 to about 7.

7. In some embodiments of the method of any of the preceding paragraphs, the method conducted at the temperature range of 10-90° C., preferably 15-80° C., more preferably 20-70° C., more preferably 30-70° C., more preferably 35-65° C., and even more preferably 30-50° C.

8. In some embodiments of the method of any of the preceding paragraphs, the peroxidase comprises or consists of an amino acid sequence which has at least 80% identity, such as at least 85% identity, at least 90% identity or at least 95% identity to SEQ ID N0:1 or SEQ ID N0:2.

9. The method of treating textile is provided, comprising (a) contacting the textile with cellulase; (b) contacting a textile with a peroxidase, a source of hydrogen peroxide, and a mediator according to any one of claims 1-8, wherein step (a) and (b) are performed sequentially or simultaneously in the same bath.

10. In some embodiments of the method of paragraph 9, step (a) is preceded by an enzymatic desizing step.

11. In some embodiments of the method of paragraph 10, the enzymatic desizing step is to contact textile with amylase.

12. In some embodiments of the method of paragraph 11, step of contacting textile with amylase, step (a) and step (b) occur sequentially or simultaneously in the same bath.

13. In some embodiments of the method of any of the preceding paragraphs, the treating textile is manufacturing the textile.

14. In some embodiments, the method of any of the preceding paragraphs achieves color modification on the front side of the textile.

15. A composition is provided, comprising a peroxidase, a source of hydrogen peroxide, and a mediator having the chemical structure:

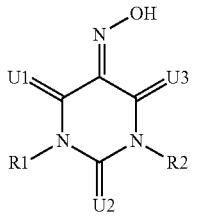

wherein U1, U2 and U3 are identical or different, and are O, S or NOH; and R1 and R2 are identical or different, and are hydrogen, hydroxyl, formyl, carbamoyl or sulfono radical, ester or salt of the sulfono radical, sulfamoyl, nitro, nitroso, amino, cyano, phenyl, benzyl $C_1$-$C_4$-alkyl, $C_1$-$C_4$-alkoxy, $C_1$-$C_4$-carbonyl, or carbonyl-$C_1$-$C_4$-alkyl.

16. In some embodiments of the method of paragraph 15, U1, U2 and U3 are O; and R1 and R2 are identical or different, and are hydrogen, hydroxyl, methyl, ethyl, phenyl, benzyl, formyl, amino, cyano, nitroso, methoxy and/or ethoxy.

17. In some embodiments of the method of paragraph 16, the mediator is selected from 1-methylvioluric acid, 1,3-dimethylvioluric acid, thiovioluric acid, violuric acid, and esters, ethers, salts or hydrates thereof.

18. In some embodiments of the method of any of paragraphs 15-17, which is an aqueous composition with a pH of from about a pH of from about 2 to about 8, preferably, preferably about 3 to about 7, more preferably more preferably about 4 to about 7.

19. Use of the composition of any of paragraphs 15-18 for color modification of textile is provided.

20. In some embodiments of the method or the composition or the use of any of the preceding paragraphs, the method or the composition of the present invention achieve color modification on the front side of the textile, preferably the color modification with the bleaching level on the front side of at least 1.5 Delta L* unit, more preferably at least 1.6, more preferably at least 1.7, more preferably at least 1.8, more preferably at least 1.9, more preferably at least 2, more preferably at least 2.1, more preferably at least 2.2, more preferably at least 2.3, more preferably at least 2.4, more preferably at least 2.5, more preferably at least 2.6, even more preferably at least 2.7, even more preferably at least 2.8, even more preferably at least 2.9, even most preferably at least 3 Delta L* unit under testing conditions as specified in Example 1.

EXAMPLES

Materials & Methods

The amino acid sequence of *Coprinus cinereus* peroxidase (CiP) is shown as SEQ ID NO:1.

The amino acid sequence of soybean peroxidase (SBP) is shown as SEQ ID NO:2.

The amino acid sequence of *Myceliophthora thermophila* laccase (MtL) is shown as in WO95/33536, sequence number 2.

Cellusoft L® (a *Trichoderma reesei* multi-component cellulase product, commercially available from Novozymes A/S)

Denimax® Core 1380 S (an enzyme product containing cellulase and alpha-amylase, commercially available from Novozymes A/S)

VA: violuric acid

HOBT: 1-hydroxy-benzotriazole

MS: Methylsyringate

Colour Measurement

The bleaching level of the denim samples were determined by measuring the reflectance with pre-calibrated DataColor SF450X, alternatively an equivalent apparatus can be used. Four readings were taken for each sample, and the average of the readings were used. The bleaching level was evaluated with the index CIE L* on the blue side (front side) of the sample, and the index CIE b* on the back side of the sample.

L* indicates the color change in white/black on a scale from 0 to 100, and a decrease in L* means an increase in black colour (decrease in white colour) and an increase in L* means an increase in white colour (decrease in black colour). Delta L* unit=L* of the swatch treated with a certain enzyme—L* of the swatch before enzyme treatment. The larger the Delta L* unit is, the brighter and/or whiter the denim is, thus the higher is the bleaching level (e.g. a Delta L* unit of 6 has higher bleaching level than Delta L* unit of 4).

b* indicates the color change in blue/yellow, and a decrease in b* means an increase in blue colour (decrease in yellow colour), and an increase in b* means an increase in yellow colour (decrease in blue colour). Delta b* units=b* of the swatch treated with a certain enzyme—b* of the swatch before enzyme treatment. The larger the Delta b* unit is, the brighter and/or whiter the back side of the denim is, thus the higher is the bleaching level on the back side (e.g. a Delta b* unit of 3 has higher bleaching level than Delta b* unit of 1).

Protein Content

The enzyme protein in an enzyme product can be measured with BCA™ Protein Assay Kit (product number 23225, commercial available from Thermo Fisher Scientific Inc.) according to the product manual.

Example 1

Color Modification with CiP/VA in Launder-O-Meter Under Different Dosages

The effects of *Coprinus cinereus* peroxidase/violuric acid (CiP/VA) on the denim were tested in Launder-O-Meter (SDL-Atlas LP2), including the bleaching level under different dosages.

Denim after abrasion was cut to 16 cm tall and 27 cm long. The denim was sewn, forming a tube with height of 12.5 cm and weight of about 22 g. The tubes were placed in a condition room (65% relative humidity, 20° C.) for 24 hours before they were numbered, weighted by the analytical balance and recorded. One conditioned tube was placed in 200 ml each breaker, with the blue side facing inward. For each beaker, 30 big nut (M10 M-SR-A4-80, acid proof), 10 small nuts (M6 M-SR-A4-80, acid proof), 7 big star magnets (diameter 17 mm, item no.3-CO-411117, Cowie, Schweiz via Bie & Berntsen), and 3 small star magnets (diameter 14 mm, item no. 3-CO-11117, Cowie, Schweiz via Bie & Berntsen) were used to supply the mechanical aids. Then the buffer (50 mM of sodium acetate buffer, pH=5.0) and the peroxidase and the mediator were added according to Table 1, based on the calculation of actual fabric weights, to make a total volume around 176 ml, which would create a liquid to fabric ratio of 8:1(v/w ml/g). $H_2O_2$ was added according to Table 1 into the solution to begin the reaction.

Meanwhile, the Launder-O-Meter (LOM) machine was started after the required program was chosen, and it would hold when the temperature reached 55° C. Each beaker was fitted with a lid lined with 2 neoprin gaskets and close tightly with the metal clamping device. The beakers were loaded into the preheated LOM. Metal racks were used to accommodate and secure 6 beakers, in the horizontal position, in each of the 4 drum positions. The LOM lid was closed and the washing program was continued and the timing was initiated.

30 minutes (min) later, all beakers were removed and the denim samples were transferred to the inactivation solution (2 g/L sodium carbonate) at 85° C. for 10 minutes. Then the swatches (i.e. denim) were rinsed in hot water for 2 times and in cold water for 2 times. The denim samples were tumble-dried (machined available from AEG, LAVATHERM 37700, Germany), and the samples were conditioned for 24 hours at 20° C., 65% relative humidity prior to evaluation.

The bleaching level of the denim samples were determined by measuring the reflectance with pre-calibrated DataColor SF450X. Four readings were taken for each sample. The bleaching level was evaluated with the index CIE L* of the blue side of the sample, and with the index CIE b* of the back of the sample. For both L* and b*, 4 readings were conducted for each fabric and the average of the four readings were used.

Cip/VA system resulted in surprisingly high increase in bleaching level (higher Delta L* and Delta b* units) compared with blank group (without adding CiP, VA and $H_2O_2$) and control group (adding $H_2O_2$). As shown in table 1, the optimum dosages for CiP, VA and $H_2O_2$ are 0.015 mg enzyme protein/g fabric, 0.5 mM/L and 0.05 g/L respectively. *Coprinus cinereus* peroxidase and violur acid (CiP/VA) system works well over a broad dosage range, by increasing the bleaching level on both sides.

TABLE 1

Results of bleaching level by CiP/VA system under different dosages (55° C., pH 5.0, 30 minutes)

| CiP (mg enzyme protein/g denim) | VA (mM/L) | $H_2O_2$ (g/L) | Denim fabrics Delta L* | Denim fabrics Delta b* |
|---|---|---|---|---|
| 0.001 | 0.25 | 0.1 | 3.13 | 1.11 |
| 0.005 | | | 6.45 | 2.02 |
| 0.015 | | | 6.7 | 3.47 |
| 0.030 | | | 8.07 | 3.18 |
| 0.015 | 0.05 | 0.1 | 2.29 | 0.76 |
| | 0.10 | | 4.33 | 1.79 |
| | 0.25 | | 6.70 | 3.47 |
| | 0.50 | | 12.90 | 3.75 |
| 0.015 | 0.25 | 0.02 | 6.51 | 2.59 |
| | | 0.05 | 9.43 | 4.47 |
| | | 0.1 | 6.70 | 3.47 |
| | | 0.2 | 5.65 | 2.61 |
| 0 | 0 | 0 | 0.55 | 0.02 |
| 0 | 0 | 0.1 | 0.58 | 0.09 |

Note:
average of twice samples for each dosage.

Example 2

Color Modification with CiP/VA in LOM Under Different Reaction Conditions

The effects of the CiP/VA on denim were tested under the reaction conditions as shown in Table 2 with the same protocol as Example 1. The dosage of CiP was set as 0.015 mg enzyme protein/g fabric, VA was 0.5 mM/L and $H_2O_2$ was 0.05 g/L. The pH=4 and pH=5 buffers were 50 mM of sodium acetate buffer, the pH=6 and pH=7 were 50 mM phosphate buffer.

Blank group (without adding CiP, VA and $H_2O_2$) and control group (adding $H_2O_2$ with 0.1 g/l) were both conducted at pH 5, temperature 55° C. for 30 minutes.

As shown in Table 2, we can conclude that the CiP/VA system shows activity over a broad temperature range from 25 to 65° C.) and pH range from 4 to 7. It works better in low temperature such as from 25 to 45° C. The reaction rate of CiP/VA is very rapid with the main bleaching action finished within the first 10 minutes.

TABLE 2

Results of bleaching level by CiP/VA system under different pH, temperature and time.

| pH | Temperature (° C.) | Time (min) | Denim fabrics Delta L* | Denim fabrics Delta b* |
|---|---|---|---|---|
| 4 | 55 | 30 | 11.00 | 3.32 |
| 5 | | | 10.75 | 3.77 |
| 6 | | | 5.79 | 1.01 |
| 7 | | | 2.54 | 0.68 |
| 5 | 25 | 30 | 11.05 | 1.17 |
| | 35 | | 11.13 | 2.89 |
| | 45 | | 10.49 | 2.76 |
| | 55 | | 9.24 | 3.42 |
| | 65 | | 7.09 | 3.66 |
| 5 | 55 | 10 | 8.59 | 2.91 |
| | | 20 | 8.79 | 2.74 |
| | | 30 | 9.31 | 2.44 |
| | | 60 | 9.98 | 1.72 |
| | Blank Group | | 0.55 | 0.02 |
| | Control Group | | 0.58 | 0.09 |

Note:
average of twice samples for each condition

Example 3

Comparative Data of CiP/VA with Prior Products on Color Modification of Denim in LOM The performances of CiP/VA, CiP/HOBT, SBP/VA, and MtL/MeS were evaluated under the reaction conditions as shown in Table 3 with the same protocol as Example 1. The treating time in this example was set as 30 minutes. The pH=5 buffer was 50 mM of sodium acetate buffer and the pH=6.5 was 50 mM phosphate buffer.

As shown in Table 3, both CiP (SEQ ID NO:1) and SBP (SEQ ID NO:2) improve the bleaching effect. Comparing with the commercial product (CiP/HOBT), the CiP/VA or SBP/VA system is more efficient than CiP/HOBT system with increased bleaching level (higher Delta L* unit and higher Delta b*). VA is superior to the HOBT mediator in the peroxidase/mediator system for color modification.

As shown in Table 3, CiP/VA or SBP/VA systems perform better in bleaching level compared with the commercial laccase/mediator system (MtL/MeS).

TABLE 3

Results of CiP/VA and different Enzyme/Mediator systems on denim bleaching in LOM

| Enzyme/ mediator | Washing conditions | Enzyme dosage | Mediator dosage | $H_2O_2$ dosage | Denim fabrics Delta L* | Denim fabrics Delta b* |
|---|---|---|---|---|---|---|
| CiP/VA | 55° C., | 0.015 mg/g | 0.5 mM/L | 0.1 g/L | 6.71 | 2.27 |
| CiP/HOBT | pH = 5.0, | denim | 0.5 mM/L | | 1.86 | 0.3 |
| SBP/VA | 30 min | fabric | 0.5 mM/L | | 6.12 | 1.56 |
| MtL/MeS | | | 0.5 mM/L | | 5.32 | 1.45 |

Note:
average of twice samples for each condition

Example 4

Color Modification with CiP/VA in Combination with Cellulase in LOM in One Bath The one-bath combined abrasion and bleaching process refers to doing denim abrasion and bleaching step by step in the same bath without draining and rinsing in between, while normally the abrasion and bleaching are two separated processes carried out in different treating baths. In this example, the normal processes of abrasion and bleaching were set as the control, where the denim was rinsed after abrasion while bleaching happened in another bath afterwards.

Denim abrasion step: Denim fabric after desizing was cut into the same size and prepared into tube shape and placed in LOM beaker with the same nuts as described in Example 1. Then the buffer (50 mM of sodium acetate buffer, pH=5.0) and the cellulase product (Cellusoft® L) was added according to Table 4, based on the calculation of actual fabric weights, with a liquid to fabric ratio of 8:1(v/w, ml/g). The beakers were loaded into the preheated LOM. The abrasion was then started in LOM at 55° C. performed in the same way as those described in paragraph 3 of Example 1. Forty minutes later, all beakers were taken out of the LOM for the next step of bleaching either in a different bath or in the same bath.

Control process (bleaching in a different bath from the abrasion bath): For the control swatch, the abrasion bath was drained and the swatch was rinsed in hot water for 2 times and in cold water for 2 times. The swatch was then placed in the beaker again with nuts as described in paragraph 2 of Example 1. And then, buffer (50 mM of sodium acetate buffer, pH=5.0) was added, followed by the addition of peroxidase, mediator and $H_2O_2$ according to Table 4, with the liquid to fabric ratio of 8:1(v/w, ml/g). The beaker was reloaded in LOM and the washing program was continued for 30 min at 55° C. for the bleaching step.

Combined process (abrasion and bleaching in the same bath): For the swatches of the combined process, peroxidase, mediator and $H_2O_2$ were directly added into the abrasion bath containing beakers according to Table 4. The beakers were reloaded in LOM and the washing program was continued for 30 min at 55° C. for the bleaching.

After the bleaching step in both control process and combined process, all beakers were removed and the denim samples were transferred to the inactivation solution (2 g/L sodium carbonate) at 85° C. for 10 minutes. Then the swatches were rinsed in hot water for 2 times and in cold water for 2 times. The denim samples were tumble-dried, conditioned and evaluated for bleaching level in the same way as those described in Example 1.

Table 4 shows that the combined process could reach the same Delta L* level as that in the control process, when the dosage of CiP/VA/H202 system is somewhere between the double and the triple dosage as used for the control process.

The example shows that CiP/VA/H202 system is suitable for use in the combined abrasion and bleaching process in one bath.

TABLE 4

Results of the one-bath combined process with Cellusoft ® L and CiP/VA in LOM

| Process | Cellusoft ® L, % of denim weight | CiP, mg enzyme protein/g denim | VA, mM/L | $H_2O_2$, g/L | Denim fabrics Delta L* | Delta b* |
|---|---|---|---|---|---|---|
| Control | 1.00 | 0.015 | 0.25 | 0.05 | 13.615 | −1.1 |
| Combined | 1.00 | 0.030 | 0.50 | 0.10 | 12.025 | −1.395 |
| process | 1.00 | 0.045 | 0.75 | 0.20 | 15.505 | −2.02 |

Notes:
average of duplicate samples for each combination.

Example 5

Color Modification with CiP/VA in Combination with Desizing and Abrasion in a One-Bath The one-bath combined process in this example refers to conducting denim desizing, abrasion and bleaching in the same bath without draining and rinsing in between. In this example, the control process was first to do desizing and abrasion in the same bath simultaneously, then the denim swatch was rinsed while bleaching happened in another bath afterwards.

The desizing and abrasion step were conducted in WASCATOR (Electrolux, Switzerland) to ensure enough mechanical action for the process. WASCATOR is a washer extractor with a capacity of 7 kg fabric, controlled by a microprocessor-based program control unit, which generates a higher mechanical action than LOM, so the sizing agent in the denim fabric could be easily removed with the help of amylase to ensure the fabric with enough desizing and abrasion effects prepared for the next bleaching step. 1 kg of denim tubes were loaded into WASCATOR and the washing program ran as below:

| | |
|---|---|
| Pre-wash | 25° C., 5 min; liquid to fabric ratio 15:1 (v/w). |
| Drain | |
| Main wash | Enzyme product Denimax ® Core 1380 S containing both alpha-amylase and cellulase is added according to Table 5; 50° C., for 85 minutes; liquid to fabric ratio 10:1 (v/w); the bath pH was 6.5 under the test condition. |
| After wash | Denim tubes and treating bath were collected respectively for the next step of bleaching either in a different bath or in the same bath. |

Control process: The swatches for the control were rinsed in hot water for 2 times and in cold water for 2 times, and then were cut into small tubes and placed in the beakers again with nuts as described in Example 1. After that, buffer (50 mM of sodium acetate buffer, pH=5.0) was added, followed by the addition of peroxidase, mediator and $H_2O_2$ according to Table 5, with the liquid to fabric ratio of 10:1(v/w ml/g). The beaker was reloaded in LOM and the washing program was continued for 30 min at 40° C. for the bleaching step.

Combined process: The swatches for combined process were cut into small tubes and placed in the beakers with nuts as described in Example 1. The bath collection from WASCATOR was adjusted to pH 5 by acetic acid, and added into the beakers. The peroxidase, mediator and $H_2O_2$ were added according to Table 5, with the liquid to fabric ratio of 10:1(v/w ml/g). The beakers were reloaded in LOM and the washing program was continued for 30 min at 40° C. for the bleaching.

After the bleaching step in both control process and combined process, all beakers were removed and the denim samples were transferred to the inactivation solution (2 g/L sodium carbonate) at 85° C. for 10 minutes. Then the swatches were rinsed in hot water for 2 times and in cold water for 2 times. The denim samples were tumble-dried, conditioned and evaluated for bleaching level in the same way as those described in Example 1.

Table 5 shows that the combined process could reach the same Delta L* level as the control process, when the dosage of CiP/VA/H202 system was somewhere between six and seven times of the dosage used for the control process. The example shows that CiP/VA/H202 system is suitable for use in the combined desizing, abrasion and bleaching process in one bath.

TABLE 5

Results of the one-bath combined process with Denimax ® Core 1380 S and CiP/VA

| Process | Denimax ® Core 1380 S, % of denim weight | CiP (mg enzyme protein/g denim) | VA mM/L | $H_2O_2$ g/L | Denim fabrics Delta L* | Delta b* |
|---|---|---|---|---|---|---|
| Control | 3 | 0.015 | 0.19 | 0.04 | 17.595 | −0.705 |
| Combined | 3 | 0.090 | 1.14 | 0.24 | 17.37 | −3.255 |
| process | 3 | 0.105 | 1.33 | 0.28 | 18.155 | −3.405 |

Notes:
average of duplicate samples for each enzyme combination

Example 6

Color Modification with CiP/VA Using Sodium Percarbonate or Urea Hydrogen Peroxide as Hydrogen Peroxide Donor in WASCATOR Denim bleaching trials were conducted in Wascator (Electrolux, Switzerland). For each trial, six pieces of large denim tubes weighed up around 1 kg were loaded together. 50 mM of sodium acetate buffer was used to control the bath at pH 5. The peroxidase, mediator and hydrogen peroxide source ($H_2O_2$ or sodium percarbonate or urea hydrogen peroxide) were added according to Table 6. The $H_2O_2$ release amount of the sodium percarbonate and urea hydrogen peroxide is 28.30% and 35.08% respectively. At the dosages in Table 6, both sodium percarbonate and urea hydrogen peroxide would release $H_2O_2$ to the amount of 0.06 g/L. The trials conditions were described as below:

| | |
|---|---|
| Main wash | Cip, VA and hydrogen peroxide source were added according to Table 6; 40° C. for 20 minutes; liquid to fabric ratio 10:1 (v/w); pH 5 with 50 mM of sodium acetate buffer. |
| Drain | |
| Rinse | 25° C., 5 min; liquid to fabric ratio 15:1 (w/w) |
| Drain | |
| Rinse | 25° C., 5 min; liquid to fabric ratio 15:1 (w/w) |
| Drain | |
| Extracted and Tumble-dried | |

The results in Table 6 show that sodium percarbonate or urea hydrogen peroxide could reach similar bleaching level as $H_2O_2$.

TABLE 6

Results of using different hydrogen peroxide sources for CiP/VA bleaching in Wascator

| Hydrogen peroxide | | CiP (mg enzyme | VA | Denim fabrics | |
|---|---|---|---|---|---|
| Source | g/L | protein/g denim) | (mM/L) | Delta L* | Delta b* |
| $H_2O_2$ | 0.06 | 0.015 | 0.19 | 8.03 | 1.84 |
| Sodium percarbonate | 0.212 | 0.015 | 0.19 | 8.05 | 1.85 |
| Urea hydrogen peroxide | 0.171 | 0.015 | 0.19 | 7.56 | 1.72 |

Example 7

Local Color Modification with CiP/VA

Denim after abrasion was cut to 16 cm tall and 27 cm long. The denim was sewn, forming a rectangle swatch with height of 12.5 cm and weight of about 22 g. Place the swatch blue side up onto a hoop with a diameter of 10 cm to make the central part of the swatch horizontally suspended.

1 ml of the CiP/VA mixture (CiP=0.221 mg Enzyme Protein/g mixture; VA=0.028 mM/g mixture) was dropped at the central of the swatch and the penetration happened automatically. After 5 min, the swatch was made into a tube shape and placed in the beaker with nuts as described in Example 1. Buffer (50 mM of sodium acetate buffer, pH=5.0) and $H_2O_2$ were then added, making the bath had a $H_2O_2$ content of 0.69 g/L and a liquid to fabric ratio of 10:1 (v/w ml/g). The beaker was loaded in LOM and the washing program was continued for 20 min at 25° C. After 20 min, the washing bath was drained, and NaOH solution (1 g/L) was added into the beaker with a liquid to fabric ratio of 10:1(v/w ml/g). The beaker was reloaded in LOM and the washing program was continued for 10 min at 25° C.

Then the swatches were rinsed in hot water for 2 times and in cold water for 2 times. The denim samples were tumble-dried, conditioned and evaluated for bleaching level in the same way as those described in Example 1.

Delta L* value of the central point of the swatch was 14.30, while the Delta L* value at the edge (5 cm away from the central point) was 3.99. This result indicated that the central area was much more bleached than the edge area, and a local bleached pattern could thus be formed on the fabric.

The invention described and claimed herein is not to be limited in scope by the specific aspects herein disclosed, since these aspects are intended as illustrations of several aspects of the invention. Any equivalent aspects are intended to be within the scope of this invention. Indeed, various modifications of the invention in addition to those shown and described herein will become apparent to those skilled in the art from the foregoing description. Such modifications are also intended to fall within the scope of the appended claims. In the case of conflict, the present disclosure including definitions will control.

SEQUENCE LISTING

```
<160> NUMBER OF SEQ ID NOS: 2

<210> SEQ ID NO 1
<211> LENGTH: 343
<212> TYPE: PRT
<213> ORGANISM: Coprinus cinereus

<400> SEQUENCE: 1

Gln Gly Pro Gly Gly Gly Gly Ser Val Thr Cys Pro Gly Gly Gln Ser
1               5                   10                  15

Thr Ser Asn Ser Gln Cys Cys Val Trp Phe Asp Val Leu Asp Asp Leu
            20                  25                  30

Gln Thr Asn Phe Tyr Gln Gly Ser Lys Cys Glu Ser Pro Val Arg Lys
        35                  40                  45
```

```
Ile Leu Arg Ile Val Phe His Asp Ala Ile Gly Phe Ser Pro Ala Leu
    50                  55                  60

Thr Ala Ala Gly Gln Phe Gly Gly Gly Gly Ala Asp Gly Ser Ile Ile
65                  70                  75                  80

Ala His Ser Asn Ile Glu Leu Ala Phe Pro Ala Asn Gly Gly Leu Thr
                85                  90                  95

Asp Thr Val Glu Ala Leu Arg Ala Val Gly Ile Asn His Gly Val Ser
            100                 105                 110

Phe Gly Asp Leu Ile Gln Phe Ala Thr Ala Val Gly Met Ser Asn Cys
        115                 120                 125

Pro Gly Ser Pro Arg Leu Glu Phe Leu Thr Gly Arg Ser Asn Ser Ser
    130                 135                 140

Gln Pro Ser Pro Pro Ser Leu Ile Pro Gly Pro Gly Asn Thr Val Thr
145                 150                 155                 160

Ala Ile Leu Asp Arg Met Gly Asp Ala Gly Phe Ser Pro Asp Glu Val
                165                 170                 175

Val Asp Leu Leu Ala Ala His Ser Leu Ala Ser Gln Glu Gly Leu Asn
            180                 185                 190

Ser Ala Ile Phe Arg Ser Pro Leu Asp Ser Thr Pro Gln Val Phe Asp
        195                 200                 205

Thr Gln Phe Tyr Ile Glu Thr Leu Leu Lys Gly Thr Thr Gln Pro Gly
    210                 215                 220

Pro Ser Leu Gly Phe Ala Glu Glu Leu Ser Pro Phe Pro Gly Glu Phe
225                 230                 235                 240

Arg Met Arg Ser Asp Ala Leu Leu Ala Arg Asp Ser Arg Thr Ala Cys
                245                 250                 255

Arg Trp Gln Ser Met Thr Ser Ser Asn Glu Val Met Gly Gln Arg Tyr
            260                 265                 270

Arg Ala Ala Met Ala Lys Met Ser Val Leu Gly Phe Asp Arg Asn Ala
        275                 280                 285

Leu Thr Asp Cys Ser Asp Val Ile Pro Ser Ala Val Ser Asn Asn Ala
    290                 295                 300

Ala Pro Val Ile Pro Gly Gly Leu Thr Val Asp Asp Ile Glu Val Ser
305                 310                 315                 320

Cys Pro Ser Glu Pro Phe Pro Glu Ile Ala Thr Ala Ser Gly Pro Leu
                325                 330                 335

Pro Ser Leu Ala Pro Ala Pro
            340


<210> SEQ ID NO 2
<211> LENGTH: 326
<212> TYPE: PRT
<213> ORGANISM: Glycine max

<400> SEQUENCE: 2

Gln Leu Thr Pro Thr Phe Tyr Arg Glu Thr Cys Pro Asn Leu Phe Pro
1               5                   10                  15

Ile Val Phe Gly Val Ile Phe Asp Ala Ser Phe Thr Asp Pro Arg Ile
            20                  25                  30
```

-continued

```
Gly Ala Ser Leu Met Arg Leu His Phe His Asp Cys Phe Val Gln Gly
        35                  40                  45

Cys Asp Gly Ser Val Leu Leu Asn Asn Thr Asp Thr Ile Glu Ser Glu
    50                  55                  60

Gln Asp Ala Leu Pro Asn Ile Asn Ser Ile Arg Gly Leu Asp Val Val
65                  70                  75                  80

Asn Asp Ile Lys Thr Ala Val Glu Asn Ser Cys Pro Asp Thr Val Ser
                85                  90                  95

Cys Ala Asp Ile Leu Ala Ile Ala Ala Glu Ile Ala Ser Val Leu Gly
            100                 105                 110

Gly Gly Pro Gly Trp Pro Val Pro Leu Gly Arg Arg Asp Ser Leu Thr
        115                 120                 125

Ala Asn Arg Thr Leu Ala Asn Gln Asn Leu Pro Ala Pro Phe Phe Asn
    130                 135                 140

Leu Thr Gln Leu Lys Ala Ser Phe Ala Val Gln Gly Leu Asn Thr Leu
145                 150                 155                 160

Asp Leu Val Thr Leu Ser Gly Gly His Thr Phe Gly Arg Ala Arg Cys
                165                 170                 175

Ser Thr Phe Ile Asn Arg Leu Tyr Asn Phe Ser Asn Thr Gly Asn Pro
            180                 185                 190

Asp Pro Thr Leu Asn Thr Thr Tyr Leu Glu Val Leu Arg Ala Arg Cys
        195                 200                 205

Pro Gln Asn Ala Thr Gly Asp Asn Leu Thr Asn Leu Asp Leu Ser Thr
    210                 215                 220

Pro Asp Gln Phe Asp Asn Arg Tyr Tyr Ser Asn Leu Leu Gln Leu Asn
225                 230                 235                 240

Gly Leu Leu Gln Ser Asp Gln Glu Leu Phe Ser Thr Pro Gly Ala Asp
                245                 250                 255

Thr Ile Pro Ile Val Asn Ser Phe Ser Ser Asn Gln Asn Thr Phe Phe
            260                 265                 270

Ser Asn Phe Arg Val Ser Met Ile Lys Met Gly Asn Ile Gly Val Leu
        275                 280                 285

Thr Gly Asp Glu Gly Glu Ile Arg Leu Gln Cys Asn Phe Val Asn Gly
    290                 295                 300

Asp Ser Phe Gly Leu Ala Ser Val Ala Ser Lys Asp Ala Lys Gln Lys
305                 310                 315                 320

Leu Val Ala Gln Ser Lys
                325
```

The invention claimed is:

1. A method for processing a textile, comprising bleaching a dyed textile with a bleaching agent at a pH of 4-5 in an aqueous solution comprising a peroxidase, a source of hydrogen peroxide, and a mediator having the structure:

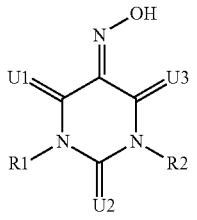

wherein

U1, U2 and U3 are identical or different and are O, S or NOH; and

R1 and R2 are identical or different and are hydrogen, hydroxyl, formyl, carbamoyl or sulfono radical, ester or salt of the sulfono radical, sulfamoyl, nitro, nitroso, amino, cyano, phenyl, benzyl C1-C4-alkyl, C1-C4-alkoxy, C1-C4-carbonyl, or carbonyl-C1-C4-alkyl.

2. The method of claim 1, wherein

U1, U2 and U3 are identical or different and are O or S; and

R1 and R2 are identical or different and are hydrogen, hydroxyl, methyl, ethyl, phenyl, benzyl, formyl, amino, cyano, nitroso, methoxy and/or ethoxy.

3. The method of claim 1, wherein

U1, U2 and U3 are O; and

R1 and R2 are identical or different and are hydrogen, hydroxyl, methyl, ethyl, phenyl, benzyl, formyl, amino, cyano, nitroso, methoxy and/or ethoxy.

4. The method of claim 1, wherein the mediator is selected from the group consisting of 1-methylvioluric acid, 1,3-dimethylvioluric acid, thiovioluric acid, violuric acid, and esters, ethers, salts and hydrates thereof.

5. The method of claim 1, wherein the textile is denim.

6. The method of claim 1, wherein the method is conducted at a temperature in the range of 30-50° C.

7. The method of claim 2, wherein the method is conducted at a temperature in the range of 30-50° C.

8. The method of claim 3, wherein the method is conducted at a temperature in the range of 30-50° C.

9. The method of claim 4, wherein the method is conducted at a temperature in the range of 30-50° C.

10. The method of claim 1, wherein the bleaching agent is an oxidizing agent.

11. The method of claim 1, wherein the bleaching agent is a reducing agent.

12. The method of claim 1, wherein the bleaching agent is an enzymatic bleaching agent.

13. The method of claim 1, wherein the peroxidase has an amino acid sequence which is at least 90% identity to SEQ ID NO: 1 or SEQ ID NO: 2.

14. The method of claim 1, wherein the peroxidase has an amino acid sequence which has at least 95% sequence identity to SEQ ID NO: 1 or SEQ ID NO: 2.

15. The method of claim 1, wherein the peroxidase has the amino acid sequence of SEQ ID NO: 1 or SEQ ID NO: 2.

16. A method for processing a textile, comprising (a) contacting a dyed textile with a cellulase; and (b) bleaching the dyed textile with a bleaching agent at a pH of 4-5 with a peroxidase, a source of hydrogen peroxide, and a mediator having the structure

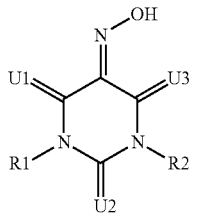

wherein

U1, U2 and U3 are identical or different and are O, S or NOH; and

R1 and R2 are identical or different and are hydrogen, hydroxyl, formyl, carbamoyl or sulfono radical, ester or salt of the sulfono radical, sulfamoyl, nitro, nitroso, amino, cyano, phenyl, benzyl C1-C4-alkyl, C1-C4-alkoxy, C1-C4-carbonyl, or carbonyl-C1-C4-alkyl, wherein steps (b) and (c) are performed sequentially or simultaneously in the same bath.

17. The method of claim 16, wherein step (a) is preceded by a desizing step comprising contacting the textile with an amylase.

18. The method of claim 17, wherein the desizing step, step (a) and step (b) occur sequentially or simultaneously in the same bath.

* * * * *